US006318973B1

(12) United States Patent
Sailer et al.

(10) Patent No.: US 6,318,973 B1
(45) Date of Patent: Nov. 20, 2001

(54) FUEL PUMP

(75) Inventors: Thomas Sailer, Amherst; Kenneth M. Beligoy, Parma Heights, both of OH (US)

(73) Assignee: Crane Co., Elyria, OH (US)

( * ) Notice: Subject to any disclaimer, the term of this patent is extended or adjusted under 35 U.S.C. 154(b) by 0 days.

(21) Appl. No.: 09/441,287

(22) Filed: Nov. 16, 1999

(51) Int. Cl.[7] ..... F04B 49/00; F04B 23/00; F16K 15/00

(52) U.S. Cl. ..... 417/310; 417/440; 137/536

(58) Field of Search ..... 417/310, 311, 417/440; 137/115.13, 115.26, 536; 251/335.2

(56) References Cited

U.S. PATENT DOCUMENTS 2,680,031 6/1954 Barr ..... 277/397
4,408,964 * 10/1983 Mochizuki et al. ..... 417/310
4,768,888 * 9/1988 McNaull ..... 384/129
5,059,099 * 10/1991 Cyphers ..... 417/311
5,290,152 * 3/1994 Wallace et al. ..... 417/68
5,520,155 * 5/1996 Hefler ..... 417/319
5,765,835 * 6/1998 Johnson ..... 277/314

* cited by examiner

*Primary Examiner*—Charles G. Freay
*Assistant Examiner*—Michael K. Gray
(74) *Attorney, Agent, or Firm*—Renner, Otto, Boisselle & Sklar, LLP

(57) ABSTRACT

A fuel pump includes an O-ring seal to provide sealing contact with a diaphragm seal between a valve housing and associated valve cover interface despite some loss of clamping load between such mating parts. Also, a molded O-ring type ladder seal is used to maintain seal integrity between the valve housing and associated pump housing interface despite some loss of clamping load therebetween. Machined O-ring grooves are desirably provided in opposite sides of the valve housing to accommodate the O-ring against the diaphragm seal and the molded O-ring type ladder seal against the pump housing.

15 Claims, 3 Drawing Sheets

FUEL PUMP

FIELD OF THE INVENTION

This invention relates generally to a fuel pump for supplying fuel to reciprocating aircraft engines and the like and more particularly to the configuration of the seals used to prevent overboard leakage of fuel at the interfaces between the valve housing and mating parts.

BACKGROUND OF THE INVENTION

Fuel pumps used to supply fuel to reciprocating aircraft engines are driven through suitable drive couplings between the pumping element and associated gear boxes inside the engines.

Because this type of pump is a positive displacement pump, the fuel output of the pump is usually greater than the fuel flow requirements of the engine or aircraft system downstream of the pump. Any excess flow is typically routed from the high pressure side of the pump back to the low pressure side through an integral bypass valve.

To prevent overboard leakage of fuel between the pump housing and mating valve housing, a flat elastomeric gasket is conventionally used to provide a seal at the pump housing/valve housing interface. In addition, a diaphragm seal is conventionally clamped between the valve housing and associated valve cover to prevent leakage at this interface.

Although such seal arrangements have generally performed quite satisfactorily over the years, their ability to prevent overboard leakage of fuel under all operating conditions is sensitive to assembly technique, compression set resistance of the elastomeric gasket and diaphragm seal, and operating temperatures. The gasket and diaphragm seal are susceptible to compression set when exposed to high thermal stresses with a corresponding reduction in the compressive pre-load on the gasket and diaphragm seal once the thermal stresses are relieved, resulting in a greater potential for a fuel leak path through the clamped joints.

SUMMARY OF THE INVENTION

In accordance with one aspect of the invention, a novel seal arrangement is provided between the valve housing and mating pump parts for maintaining the necessary sealing function therebetween regardless of joint clamping forces.

In accordance with another aspect of the invention, an O-ring seal is used to provide sealing contact with a diaphragm seal between the valve housing and valve cover interface despite some loss of clamping load.

In accordance with another aspect of the invention, a molded O-ring type ladder seal is used in place of the usual gasket between the valve housing and pump housing interface to maintain seal integrity in the event of some loss of clamping load.

In accordance with another aspect of the invention, such O-ring type seals function as long as the gland clearances are maintained with a relatively loose tolerance band compared to the squeeze tolerance required for a gasket to maintain a fluid seal between mating parts.

In accordance with another aspect of the invention, machined O-ring grooves are provided in opposite sides of the valve housing to capture and maintain a controlled squeeze of the O-ring against the diaphragm seal and the molded O-ring type ladder seal against the pump housing.

In accordance with another aspect of the invention, the valve housing with machined O-ring grooves is fabricated from wrought aluminum.

In accordance with another aspect of the invention, both the O-ring type ladder seal between the valve and pump housing interface and the standard O-ring seal against the diaphragm seal are made of a fluorocarbon material.

In accordance with another aspect of the invention, the valve housing with machined O-ring grooves is completely interchangeable with valve housings of pad mounted fuel pumps currently in service to permit such pumps to be retrofitted in the field by substituting the valve housing with O-ring grooves for the existing valve housing and removing the gasket between the valve housing and pump housing and replacing it with an O-ring type ladder seal and adding a standard O-ring against the diaphragm seal.

In accordance with another aspect of the invention, alien head valve cover screws are used in place of the usual slotted head valve cover screws to eliminate the potential for stripping of the screw heads during assembly and provide a visual indicator that fuel pumps currently in service have been retrofitted with a valve housing with machined O-ring grooves and associated O-ring type seals.

These and other aspects, advantages and features of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
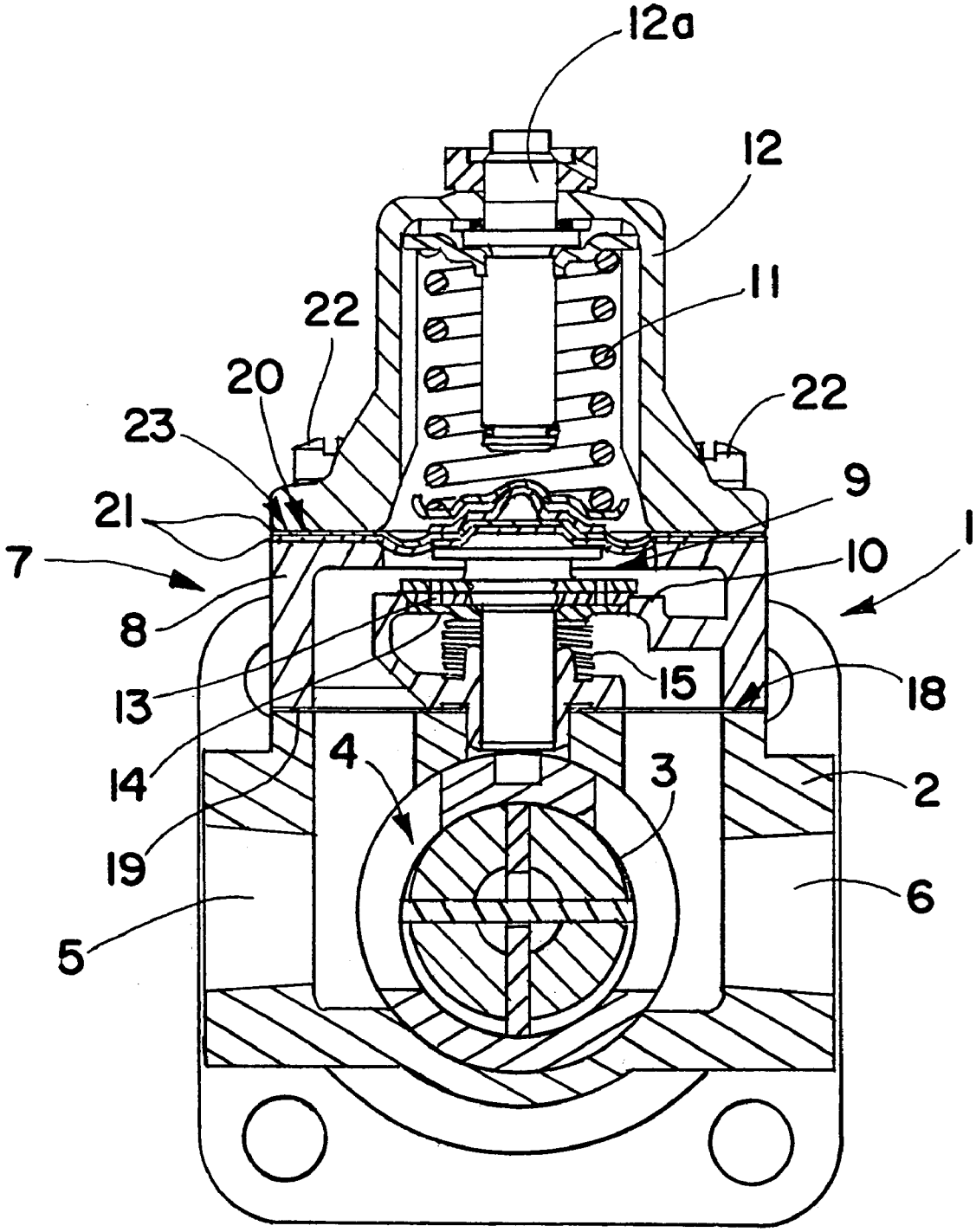
FIG. 1 PRIOR ART
FIG. 1 is a fragmentary longitudinal section through a prior art fuel pump showing the usual gasket and diaphragm seals used to prevent overboard leakage of fuel at the interfaces between the valve housing and associated pump housing and valve cover.

Referring now in detail to the drawings, and initially to FIG. 1, there is shown one known form of positive displacement pump 1 used to supply fuel to reciprocating aircraft engines and the like. The pump 1 includes a pump housing 2 containing a pump chamber 3 in which is rotatably mounted a vane type pumping element 4. The pumping element 4 is driven through a suitable drive coupling between the pump element and associated gear box inside the engine (not shown). As the pumping element 4 is rotated, fuel is drawn into the inlet port 5 and exits through the discharge port 6 of the pump housing 2.

Because this type of pump is a positive displacement pump, the fuel output of the pump is usually greater than the fuel flow requirements of the engine or aircraft system downstream of the pump. Any excess flow is typically routed from the pump outlet 6 back to the pump inlet 5 through an integral bypass valve 7 suitably attached to the pump housing 2. The bypass valve 7 includes a valve housing 8 containing a valve poppet 9 that is biased into seated engagement with a fixed valve seat 10 within the valve housing 8 by a spring 11 received within a valve cover 12. The force of spring 11 is adjustable by turning adjustment screw 12*a* in order to regulate the output pressure of the pump. When the discharge pressure exceeds the regulated value, the valve poppet 9 moves out of engagement with the valve seat 10 and excess flow is routed past the valve poppet 9, through passages in the valve housing 8 and back to the inlet 5.

Extending through the valve poppet 9 radially inwardly of the valve seat 10 are a plurality of circumferentially spaced flow passages 13 which are normally closed by a washer 14 that is pressed up against the bottom side of the valve poppet by a light spring 15 and by the force created by the difference in discharge pressure and inlet pressure. During idle conditions where the pump is not rotating, if the inlet pressure exceeds the discharge pressure by a predetermined amount, this pressure acting on the washer 14 through the flow passages 13 in the valve poppet 9 causes the washer to move out of engagement with the valve poppet thus allowing flow to be routed from the inlet port to the outlet port through the flow passages in the valve poppet, as well known in the art.

To prevent overboard leakage of fuel between the mating surfaces of the pump housing 2 and associated valve housing 8, a flat elastomeric gasket 19 is conventionally clamped between the pump housing and valve housing interface 18 to provide a fluid seal therebetween. Additionally, a diaphragm seal 20 (which usually comprises two virtually identical diaphragm seal members 21 for redundancy) is conventionally clamped between the valve housing 8 and valve cover 12 interface 23 to prevent leakage between these two surfaces. Also, the diaphragm seal 20 prevents fuel leakage into the valve cover 12 while allowing relative motion between the valve poppet 9 and valve housing 8.

Although such seal arrangements have generally performed quite satisfactorily over the years, the fuel seal integrity of these seals depends on maintaining a clamping load on the gasket 19 and diaphragm seal 20 by properly torqueing the valve cover screws 22 used to attach the valve cover 12 and valve housing 8 to the pump housing 2. The gasket 19 and diaphragm seal 20 are susceptible to compression set when exposed to high thermal stresses with a corresponding reduction in the axial pre-load applied thereto by the valve cover screws once the thermal stresses are relieved, resulting in a greater potential for a fuel leak path through the clamped joints.

Figure 2:
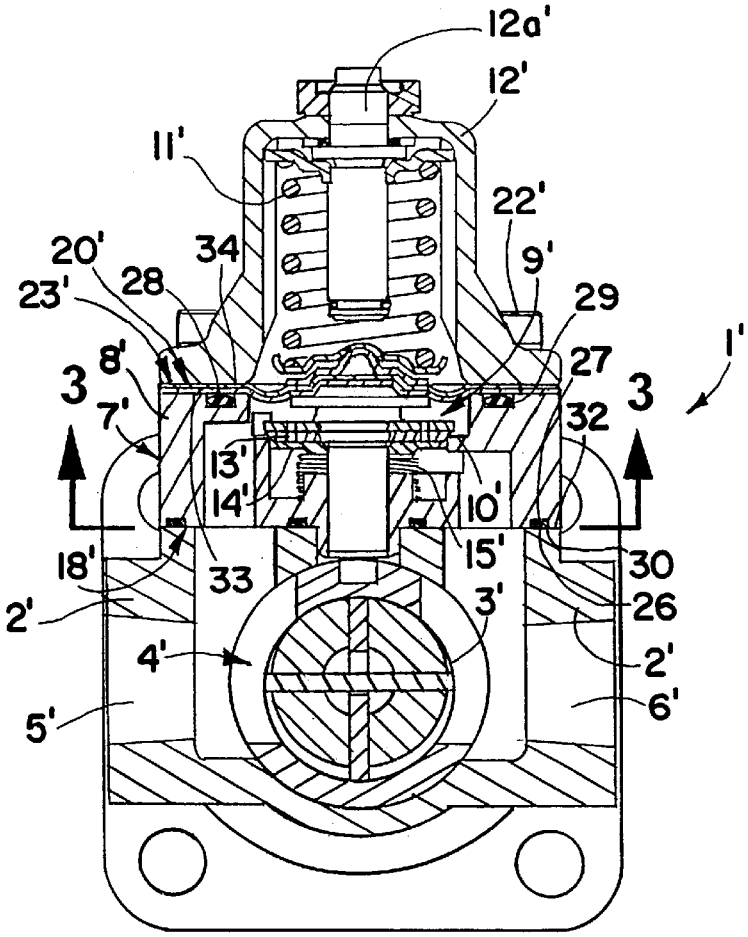
FIG. 2 is a fragmentary longitudinal section through one form of fuel pump in accordance with the present invention in which a molded O-ring type ladder seal is used in place of the usual gasket between the valve and pump housing interface and an O-ring type seal is used to provide sealing contact with a diaphragm seal between the valve housing and valve cover interface.
Figure 3:
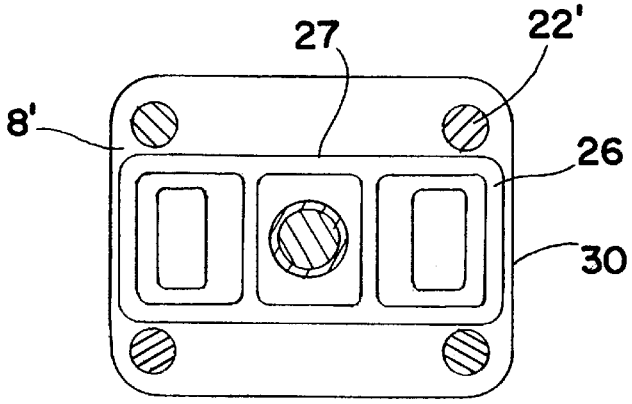
FIG. 3 is a transverse section through the fuel pump of FIG. 2, taken on the plane of the line 3—3 thereof.
Figure 4:
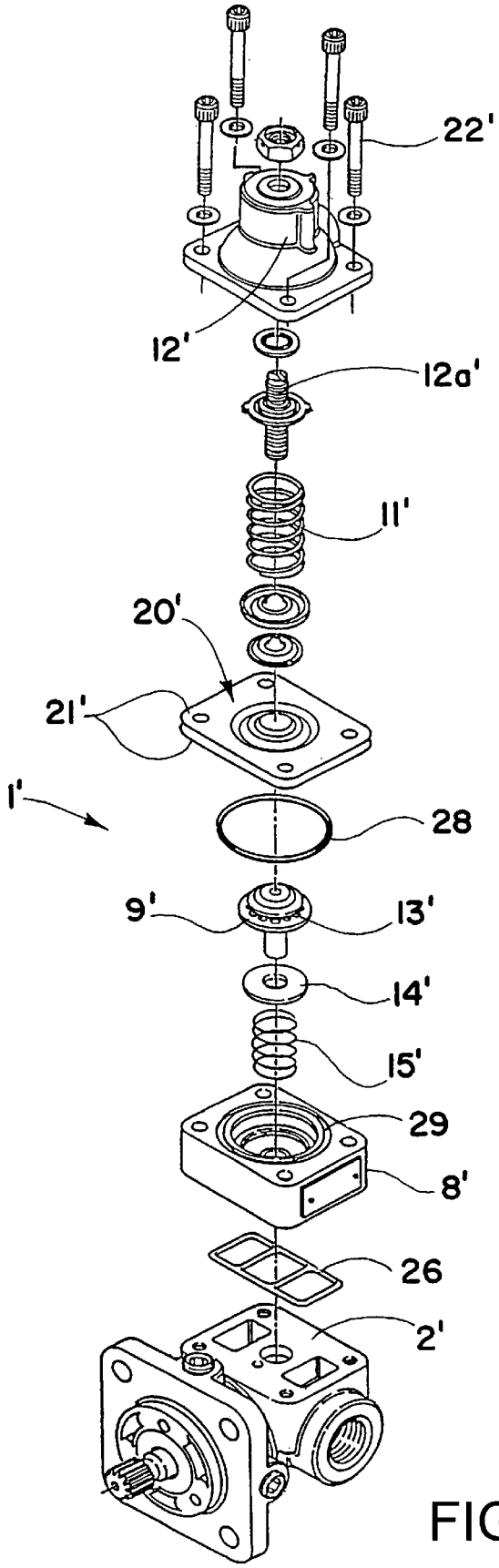
FIG. 4 is an exploded isometric view of the fuel pump of FIG. 2.

To eliminate the potential for leakage between the valve housing 8' and pump housing 2' interface 18', a molded O-ring type ladder seal 26, shown in FIGS. 2 through 4, is used in the pump 1' in place of the gasket 19, shown in FIG. 1. The ladder seal 26 is received in a correspondingly shaped groove 27 which may be provided in either of the mating surfaces 30, 32 of the valve housing 8' and pump housing 2' but is preferably provided in the mating surface 30 of the valve housing 8' for a reason to be subsequently described.

In addition, a standard large cross section O-ring 28 is used to provide sealing contact with the diaphragm seal 20' between the valve housing 8' and valve cover 12' interface 23' as further shown in FIGS. 2 through 4. The O-ring seal 28 is received in a correspondingly shaped groove 29 which may be provided in either of the mating surfaces 33, 34 of the valve cover and valve housing but is preferably provided in the mating surface 33 of the valve housing 8'.

Both the O-ring seal 28 and O-ring type ladder seal 26 will maintain the desired sealing function despite clamping load and will perform independent of the clamping force applied by torqueing the valve cover screws 22' as long as the gland clearances are maintained by the O-ring grooves 27 and 29 within a relatively loose tolerance band as compared to the squeeze tolerance required for a gasket. Therefore, seal integrity is maintained even in the event of some loss of valve cover screw torque. In addition, the seals 26 and 28 are completely captured by the machined grooves 27 and 29 in the valve housing 8', thus eliminating the possibility of seal extrusion.

Providing both O-ring grooves 27 and 29 in the valve housing 8' has the advantage that it only requires machining of one part (i.e., the valve housing 8'). Also, making the valve housing 8' completely interchangeable with the valve housing 8 of fuel pump units such as shown in FIG. 1 currently in service reduces the number of parts that need to be replaced during overhaul or retrofit of such existing pump units. That is, to overhaul or retrofit such existing fuel pump units, it will only be necessary to replace the valve housing 8 with a modified valve housing 8', the redundant diaphragm seal 20 with diaphragm seal 20' (which desirably comprises two virtually identical diaphragm seal members 21' for redundancy), the gasket 19 with the molded O-ring type ladder seal 26 and the addition of the O-ring 28 in contact with the diaphragm seal 20'. Also, when performing such overhaul or retrofit, it is desirable to replace the usual slotted head valve cover screws 22 shown in FIG. 1 with alien head valve cover screws 22' shown in FIGS. 2 through 4 to eliminate the potential for stripping the screw heads during assembly and provide a visual indicator that fuel pumps currently in service have been retrofitted with the modified valve housing 8' with O-ring grooves 27 and 29 and associated O-ring type seals 26 and 28.

Preferably, the modified valve housing 8' with machined O-ring grooves 27 and 29 is fabricated from wrought aluminum as opposed to previous valve housings 8 which were machined from a casting. Also, both the O-ring type ladder seal 26 and O-ring seal 28 are desirably made of a fluorocarbon material. Otherwise the details of construction and operation of the fuel pump 1' shown in FIGS. 2 through 4 are substantially the same as the fuel pump 1 shown in FIG. 1 and the same reference numerals followed by a prime symbol (') are used to designate like parts.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A fuel pump comprising a pump housing having a pump inlet and pump outlet, a pumping element in said pump housing for pumping fuel entering said pump inlet to said pump outlet, a valve housing having one side in mating engagement with said pump housing, said valve housing containing a bypass valve for directing any excess fuel from said pump outlet back to said pump inlet, a valve cover in mating engagement with another side of said valve housing opposite said one side, a diaphragm seal between said valve cover and said valve housing, an O-ring groove in said another side of said valve housing containing an O-ring in sealing engagement with said diaphragm seal to prevent leakage of fuel between said valve cover and said valve housing, and another seal between said valve housing and said pump housing to prevent leakage of fuel therebetween.

2. The fuel pump of claim 1 wherein said another seal comprises an O-ring type ladder seal contained within a groove in said one side of the valve housing and in sealing engagement with said pump housing.

3. The fuel pump of claim 2 further comprising fasteners attaching said valve cover, said valve housing and said pump housing together, said fasteners when tightened providing clamped joints between said valve cover and said pump housing and said another side and said one side of said valve housing, said O-ring and said O-ring type ladder seal maintaining a sealing function between said clamped joints despite some loss of fastener torque.

4. The fuel pump of claim 3 wherein said fasteners have allen screw heads to eliminate the potential for stripping of said screw heads during tightening of said fasteners.

5. The fuel pump of claim 2 wherein said valve housing is fabricated from wrought aluminum.

6. The fuel pump of claim 2 wherein said O-ring and said O-ring type ladder seal are made of fluorocarbon material.

7. The fuel pump of claim 1 wherein said diaphragm seal comprises two substantially identical diaphragm seal members between said valve cover and said valve housing for redundancy, said O-ring being in sealing engagement with one of said diaphragm seal members.

8. A fuel pump comprising a pump housing having a pump inlet and pump outlet, a pump element in said pump housing for pumping fuel from said pump inlet to said pump outlet, a valve housing containing a bypass valve for directing any excess fuel from said pump outlet back to said pump inlet, a valve cover in mating engagement with said valve housing, a diaphragm seal between first and second mating surfaces of said valve housing and said valve cover, respectively, one of said first and second mating surfaces having an O-ring groove containing an O-ring in sealing engagement with said diaphragm seal to aid in preventing leakage of fuel between said first and second mating surfaces.

9. The fuel pump of claim 8 wherein said valve housing and said pump housing have third and fourth mating surfaces, respectively, one of said third and fourth mating surfaces having another O-ring groove containing an O-ring type ladder seal in sealing engagement with the other of said third and fourth mating surfaces to prevent leakage of fuel between said third and fourth mating surfaces.

10. The fuel pump of claim 9 further comprising fasteners attaching said valve cover, said valve housing, and said pump housing together, said fasteners when tightened providing clamped joints between said first and second mating surfaces of said valve housing and said valve cover and between said third and fourth mating surfaces of said valve housing and said pump housing, said O-ring type ladder seal and said O-ring maintaining fluid seals between said clamped joints despite some loss of fastener torque.

11. The fuel pump of claim 10 wherein said O-ring groove and said another O-ring groove are in said surfaces of said valve housing.

12. The fuel pump of claim 10 wherein said fasteners have allen screw heads.

13. The fuel pump of claim 10 wherein said valve housing is fabricated from wrought aluminum.

14. The fuel pump of claim 10 wherein said O-ring type ladder seal and said O-ring are made of fluorocarbon material.

15. The fuel pump of claim 8 wherein said diaphragm seal comprises two substantially identical diaphragm seal members between said first and second mating surfaces of said valve housing and said valve cover for redundancy, said O-ring being in sealing engagement with one of said diaphragm seal members.

* * * * *